US012721482B2

(12) United States Patent
DeMonteiro et al.

(10) Patent No.: US 12,721,482 B2
(45) Date of Patent: Sep. 1, 2026

(54) DISPENSING DEVICE HAVING IMPROVED PERFORMANCE

(71) Applicant: Kimberly-Clark Worldwide, Inc., Neenah, WI (US)

(72) Inventors: Vannarak DeMonteiro, Suwanee, GA (US); Galdric Marcotte, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/252,078

(22) PCT Filed: Dec. 18, 2020

(86) PCT No.: PCT/US2020/065846

§ 371 (c)(1),
(2) Date: May 8, 2023

(87) PCT Pub. No.: WO2022/132162

PCT Pub. Date: Jun. 23, 2022

(65) Prior Publication Data

US 2024/0008691 A1 Jan. 11, 2024

(51) Int. Cl.
*A47K 5/12* (2006.01)
*A47K 10/32* (2006.01)

(52) U.S. Cl.
CPC ..... *A47K 5/1217* (2013.01); *A47K 10/32* (2013.01); *A47K 2010/3226* (2013.01)

(58) Field of Classification Search
None
See application file for complete search history.

(56) References Cited

U.S. PATENT DOCUMENTS

| | | | | |
|---|---|---|---|---|
| 2016/0165387 | A1 | 6/2016 | Nhu | |
| 2018/0080807 | A1* | 3/2018 | Singh | B05B 12/004 |
| 2018/0364672 | A1* | 12/2018 | Kamatchi | A61L 2/22 |
| 2019/0314843 | A1 | 10/2019 | Nour-Omid et al. | |
| 2021/0409149 | A1* | 12/2021 | Deng | H04W 4/70 |
| 2022/0113182 | A1* | 4/2022 | Henry | G08C 17/02 |

FOREIGN PATENT DOCUMENTS

| | | | |
|---|---|---|---|
| AU | 2014227493 | B2 | 4/2015 |
| CN | 1901829 | A | 1/2007 |
| CN | 106793894 | A | 5/2017 |

OTHER PUBLICATIONS

PCT Search Report Corresponding to Application No. PCT/US2020/065846 on Apr. 7, 2021.
Chinese Search Report Corresponding to Application No. 202080107387.4 on Jul. 22, 2025.

* cited by examiner

*Primary Examiner* — Paul B Yanchus, III
(74) *Attorney, Agent, or Firm* — Dority & Manning, P.A.

(57) ABSTRACT

A monitoring device can be configured to be coupled to a product dispenser to provide monitoring functionality for the product dispenser. The monitoring device can include a network gateway microcontroller configured to perform operations. The operations can include establishing a wireless connection with one or more dispenser monitoring devices, each of the one or more dispenser monitoring devices associated with a dispenser. The operations can include obtaining dispenser data from the one or more dispenser monitoring devices via the wireless connection. The operations can include providing the dispenser data via an internet connection to a cloud-based management service.

17 Claims, 4 Drawing Sheets

DISPENSING DEVICE HAVING IMPROVED PERFORMANCE

RELATED APPLICATIONS

The present application is the national stage entry of International Patent Application No. PCT/US2020/065846 having a filing date of Dec. 18, 2020, which is incorporated herein in its entirety by reference thereto.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user. Currently, janitors or maintenance personnel roam the buildings in which they are working to service the washrooms, or the janitors or maintenance personnel are sent to service a particular washroom or dispenser after a problem has occurred. Fixing of a problem with the washroom after the fact results in numerous tenant complaints and overall dissatisfaction. Additionally, janitorial or maintenance personnel resources are focused on servicing emergencies and are pulled away from other tasks. Additionally, waste of product is high since janitors or maintenance personnel tend to change out products before the dispensers are empty in order to avoid running out of the products before the janitors or maintenance personnel return to once again service the dispensers.

In view of the above, those skilled in the art have spent considerable time designing smart dispensers that are intended to overcome the problems noted above. For instance, dispensers have been designed that can monitor product usage and product levels in order to prevent waste. In addition, electronic towel dispensers have been designed that automatically dispense a metered length of towel material upon sensing the presence of a user. This type of dispenser has become known in the art as a "hands-free" dispenser in that it is not necessary for the user to manually activate or otherwise handle the dispenser to initiate a dispense cycle. The control systems and mechanical aspects of hands-free dispensers are wide and varied.

SUMMARY

Aspects and advantages of embodiments of the present disclosure will be set forth in part in the following description, or can be learned from the description, or can be learned through practice of the embodiments.

One example aspect of the present disclosure is directed to a monitoring device configured to be coupled to a product dispenser to provide monitoring functionality for the product dispenser. The monitoring device can include a network gateway microcontroller configured to perform operations. The operations can include establishing a wireless connection with one or more dispenser monitoring devices, each of the one or more dispenser monitoring devices associated with a dispenser. The operations can include obtaining dispenser data from the one or more dispenser monitoring devices via the wireless connection. The operations can include providing the dispenser data via an internet connection to a cloud-based management service.

Another example aspect of the present disclosure is directed to a dispenser for dispensing a product. The dispenser can include a housing having an interior volume so as to retain a product. The dispenser can include a dispensing mechanism contained within the housing for dispensing the product. The dispenser can include one or more sensors configured to monitor the dispensing mechanism. The dispenser can include a dispenser computing device configured to control the dispensing mechanism, the dispenser computing device configured to obtain dispenser data from the one or more sensors. The dispenser can include a monitoring device comprising a network gateway microcontroller configured to perform operations. The operations can include obtaining the dispenser data from the dispenser computing device via the wireless connection. The operations can include providing the dispenser data to a cloud-based management service.

Other aspects of the present disclosure are directed to various systems, apparatuses, non-transitory computer-readable media, user interfaces, and electronic devices.

These and other features, aspects, and advantages of various embodiments of the present disclosure will become better understood with reference to the following description and appended claims. The accompanying drawings, which are incorporated in and constitute a part of this specification, illustrate example embodiments of the present disclosure and, together with the description, serve to explain the related principles.

BRIEF DESCRIPTION OF THE DRAWINGS

A full and enabling disclosure of the present disclosure is set forth more particularly in the remainder of the specification, including reference to the accompanying figures, in which.

Figure 1:
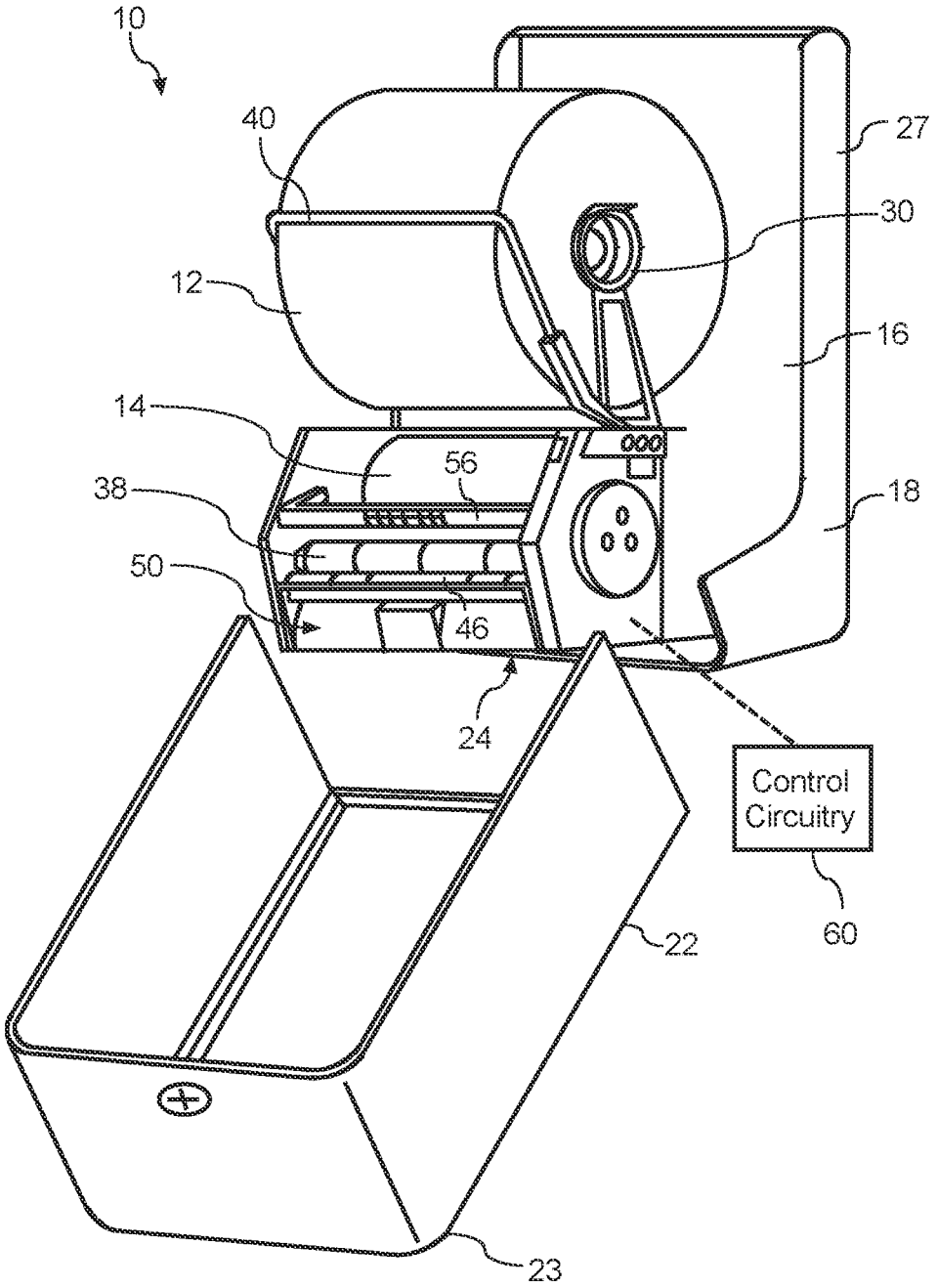
FIG. 1 depicts a perspective view of one embodiment of a dispenser with its front cover in an open position according to example embodiments of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for consumable products (e.g., toilet tissue, paper towels, soaps, feminine products, etc.) and/or to monitoring devices for a product dispenser assembly. The dispenser can include a housing having an interior volume so as to retain a product. The product can be any suitable product, such as sheet materials (e.g., paper towels), liquid materials (e.g., soaps), etc. The dispenser can include a dispensing mechanism contained within the housing for dispensing the product. The dispenser can include one or more sensors configured to monitor at least the dispensing mechanism. The dispenser can further include a dispenser computing device configured to control the dispensing mechanism. The dispenser computing device can additionally and/or alternatively be configured to obtain dispenser data from the one or more sensors. The dispenser can additionally include a monitoring device. The monitoring device can couple to and/or otherwise interact with the dispenser to control provision of data to and/or from the dispenser. Additionally and/or alternatively, the dispenser can be a manual dispenser that does not include a dispenser computing device to control the dispensing mechanism. In these cases, the sensors may provide data directly to the monitoring device.

A variety of product dispensers have been developed including a variety of sensors and control systems for operating the dispenser or providing information regarding product levels and/or other dispenser status information. Such sensors, and the data obtained from these sensors, increase efficiency for maintenance personnel. For instance, maintenance personnel can first attend to restrooms having low product levels or out of service dispensers and do not have to waste time inspecting restrooms where all of the dispensers contain adequate product amounts and are in good working order. Accordingly, sensors and, more specifically, the data obtained from dispenser sensors, are very valuable. However, current control systems generally include microprocessors to implement monitoring functionality, due to the computing resources typically required to implement the monitoring functionality. For instance, some microprocessors are tasked with acting as a "central" that collects and aggregates data from peripheral devices and transmits the data to a monitoring service. Furthermore, in commercial restroom settings a large number of dispensers and sensors may be present. Conventional processing systems typically employ microprocessors to handle the volume of devices that must be monitored. The use of microprocessors, however, can result in increased power usage and/or increased manufacturing costs of devices (e.g., dispensers), as microprocessors typically include greater amounts of computing resources. The increased power usage can especially be challenging for battery-powered devices, as it can increase the frequency at which battery replacement must be performed, which in turn increases operating costs and/or burden to dispenser maintainers. These increased costs can desirably be minimized. As such, there remains a need for improved processing architecture that eliminates the problems detailed herein.

According to example embodiments of the present disclosure, monitoring functions can be implemented (e.g., by a real-time operating system (RTOS)) on a microcontroller of the monitoring device. The microcontroller can additionally be configured to establish wireless connections with one or more other dispensers and, more particularly, in some implementations, monitoring devices of other dispensers. For instance, the microcontroller can be a microcontroller of a Bluetooth or BLE module (e.g., a Bluetooth-enabled card or chip) such as a System on a Chip (SoC). As used herein, a "microcontroller" refers to a computing unit having generally constrained resources, such as on-board memory, such as volatile memory (e.g., RAM) and/or non-volatile memory (e.g., flash memory). Additionally and/or alternatively, a microcontroller may lack expandable memory capabilities and/or a memory management unit (MMU). As one example, a microcontroller may have a limited amount of memory, such as less than about 4 megabytes of internal non-volatile memory and/or less than about 2 megabytes of internal volatile memory. Additionally and/or alternatively, a microcontroller may have a limited clock speed, such as less than about 500 kHz. This can be contrasted with a "microprocessor," which generally includes a memory management unit and/or allows expansion of memory through the addition of additional memory chips. Some microprocessors may lack internal or onboard memory entirely. Generally, implementing functionality typically assigned to a microprocessor on a microcontroller can be challenging due to the limited computing resources available to a microcontroller. For instance, implementing gateway functionality on a microcontroller (e.g., as opposed to a microprocessor) can present sizable challenges. For instance, the limitations of the microcontroller have typically seemed too constrained to suitably implement gateway functionality.

Systems and methods according to example aspects of the present disclosure provide solutions to these and other challenges. For instance, systems and methods according to example aspects of the present disclosure can facilitate providing gateway functionality for a monitoring device of a dispenser using a microcontroller that is configured for some secondary functionality, such as wireless connectivity. According to example aspects of the present disclosure, a monitoring device can be configured to be coupled to a product dispenser to provide monitoring functionality for the product dispenser. Example aspects of the present disclosure are discussed herein with reference to monitoring a dispenser for the purposes of illustration. It should be understood that various aspects of the present disclosure may find application in monitoring systems for any suitable peripheral devices.

The monitoring device can include and/or can otherwise obtain data from one or more sensors configured to monitor the product dispenser. The monitoring device can additionally include a network gateway microcontroller configured to perform operations for monitoring the product dispenser. Additionally and/or alternatively, the network gateway microcontroller can be configured to provide networking functions for the product dispenser. The network gateway microcontroller can be configured to establish a wireless connection with one or more dispenser monitoring devices. Each of the one or more dispenser monitoring devices can be associated with a dispenser. For instance, in some implementations, the network gateway microcontroller can act as a central gateway and may establish connections to and/or aggregate data associated with a plurality of other dispensers (e.g., from other monitoring devices). The network gateway controller can further be configured to provide the dispenser data to a cloud-based management service. For instance, the cloud-based management service can be a remote service (e.g., at one or more remote computing devices) that stores data associated with the dispensers and/or from which an observer (e.g., a human and/or automated observer) can monitor the dispensers. In some implementations, the monitoring device and/or the dispenser can include a cellular communication module coupled to the network gateway microcontroller. The network gateway microcontroller can be configured to provide the dispenser data to the cloud-based management service via the one or more cellular networks.

Implementing gateway functionality on a wireless protocol microcontroller to provide a network gateway microcontroller can provide a number of technical effects and benefits. For instance, the gateway functionality can be implemented on a fewer total number of processing units (e.g., microcontrollers), such as by not requiring a dedicated processing unit for the gateway functionality. Additionally and/or alternatively, this can result in a reduction in battery usage, which can decrease operational costs and/or increase time between battery replacements. Conventional microcontrollers can be heavily resource-limited, especially if the microcontrollers are designed for other functions such as wireless communications. For instance, some microcontrollers can be constrained by limited amounts of on-board memory. Additionally and/or alternatively, some microcontrollers may not allow for the addition of additional memory. Furthermore, additional memory can detrimentally contribute to footprint and/or power consumption of a microcontroller. In this way, it can be challenging to implement gateway functionality on a microcontroller. Systems and methods according to example aspects of the present disclosure, however, can beneficially provide for implementing gateway functionality on a microcontroller.

For instance, systems and methods described herein can be especially beneficial in commercial washroom management systems. For instance, commercial buildings may include a significant number of washroom dispensers. As one example, in office buildings with multiple floors, there can be multiple bathrooms on each floor, each with multiple dispensers. Thus, the entire building includes a large number of dispensers. It can be desirable to centrally manage each of the dispensers in the entire building. For instance, providing a central system for managing an entire building can improve efficiency of monitoring product level, errors, etc. of dispenser in the building, which can contribute to reduced burden on janitorial workers in manually monitoring the dispensers. Systems and methods described herein can provide for connection of all or a large number of the dispensers in a building while having reduced power usage, manufacturing costs, etc. associated with the implementation of gateway functionality at a network gateway microcontroller.

As used herein, "about" in conjunction with a stated numerical value is intended to refer to within 20% of the stated numerical value.

Referring particularly to FIG. 1, various embodiments of a dispenser 10 made according to the present disclosure are illustrated. As shown particularly in FIG. 1, the dispenser 10 includes a housing 16 that can have any desired overall shape. The housing 16 can include a two-part configuration. For example, the housing can include a back cover 18 and a front cover 22. The front cover 22 can be pivotally mounted to the back cover 18 using any suitable means. For example, in one embodiment, hinges can be used to connect the front cover 22 with the back cover 18. Alternatively, the front cover 22 can be completely separable from the back cover 18. The front cover 22 is moveable from a closed position to an open position as shown in FIG. 1. The front cover 22 defines a front face 23 while the back cover 18 defines side walls 27. In the embodiment illustrated, the side walls are entirely defined by the back cover 18. In other embodiments, however, the front cover 22 may have side walls that cooperate with the side walls of the back cover 18. The housing 16 defines an interior volume for housing the operational components of the dispenser 10, as well as the roll or rolls of sheet material to be dispensed, including a main roll 12 and a stub roll 14. The dispenser 10 can also include any conventional locking mechanism 21 for securing the front cover 22 to the back cover 18. The housing 16 further includes an opening 20 through which a sheet material is dispensed.

The dispenser configuration 10 illustrated in the figures is merely exemplary for any number of dispenser configurations known to those skilled in the art that may incorporate the monitoring device and systems of the present disclosure. As such, a detailed explanation of the structural and control features of the dispenser 10 are not necessary for purposes of explanation of the system and method of the present disclosure, and will only be discussed briefly below. Furthermore, while FIG. 1 illustrates a dispenser for sheet material the disclosure is not so limited and can include dispensing mechanisms for dispensing liquid material products, such as hand soap or hand sanitizer. Suitable operational components for dispensing liquid products are known and may be used in the dispensers provided herein.

The operational components of the dispenser 10 may be mounted directly to the back cover 18 or can be part of a module that is received within the housing 16. For example, the operational components can be part of a module that may be readily removable from the housing for servicing and/or replacing components without the necessity of having to remove the entire dispenser 10 from its support surface.

As shown in FIG. 1, the operational components can include a pressure roller 46, a transfer mechanism that may include a transfer arm 56, a throat assembly 50 that defines a throat 24, a drive motor and gear assembly that rotates a drive roller 38, and control circuitry 60 which may include a controller or microprocessor.

Left and right main roll holders 30 are attached within the housing and hold the main roll 12 of sheet material. Stub roll holders may be provided for rotatably supporting the stub roll 14 in the position within the housing below the main roll 12. It should be understood that a dispenser according to the present disclosure need not be configured to dispense from a stub roll, and thus would not need a transfer mechanism. The dispenser may be configured for dispensing from a single roll of sheet material.

The pressure roller 46 may be housed within the throat assembly 50 that is, in turn, mounted within the housing. The dispenser 10 may also include a tear bar or cutting bar that is contained within the throat assembly 50 and disposed along the dispensing path of the sheet of material upstream from the dispensing opening 20 and downstream of the nip between the drive roller 38 and the pressure roller 46. To separate a sheet of material that has been dispensed from the dispenser 10, the cutting bar can automatically cut the material or, alternatively, a user can grasp a sheet hanging from beneath a bottom portion of the housing and pulls the sheet against the cutting or tear bar such that the sheet tears and separates along a line defined by the tear or cutting bar.

The pressure roller 46 is spring biased against the drive roller 38 such that the sheet of material passing between the nip of the rollers is advanced along the dispensing path upon rotation of the drive roller 38. The throat assembly 50 defines a portion of the dispensing path and the forward portion of the dispensing throat 24. The dispenser 10 may further include an automatic transfer mechanism to transfer dispensing of the sheet of material from the stub roll 14 to a main roll 12 when the sheet of material on the stub roll 14 is nearly depleted. Any suitable transfer mechanism may be used. For example, the transfer mechanism may include a transfer bar 56 with arms pivotally mounted. The transfer bar 56 includes a roller section that may be defined by a central curved rib section. The rib section includes a securing mechanism, such as a barb, so that the leading end of the sheet of material from the main roll 12 passes over the rib section and is held by the barb while material is fed from the stub roll 14. The dispenser 10 can also include a stub roll sensing device, such as a sensing bar that is biased towards the axis of the stub roll holders so as to track the decreasing diameter of the stub roll as it is depleted. Alternatively, an electronic sensor can also be used to monitor the stub roll.

The dispenser 10 can also include a spring biased bar 40 that is pivotally mounted within the housing 16 and biased towards the center of the main roll 12 such that tracks a decreasing diameter of the main roll 12 as the sheet of material is depleted. Again, instead of a spring biased bar 40, any suitable electronic sensor may also be used. When the main roll 12 reaches a diameter suitable for moving the roll to the stub roll position, the dispenser 10 can include suitable mechanical elements for moving the main roll 12 into place for dispensing the sheet of material.

The drive roller 38 can be placed in communication with a drive motor and gear assembly. The motor can include a drive shaft and a drive gear attached thereto that engages the shaft of the drive roller 38. Thus, upon energizing the motor, the drive roller 38 is caused to rotate, which results in conveyance of the sheet of material disposed in the nip between the pressure roller 36 and the drive roller 38 along the conveying path and out of the dispensing throat 24.

The dispensing mechanism may be powered by batteries contained in a battery compartment or can be powered by an AC to DC distribution system. If the dispenser 10 includes batteries, a sensor can also be included for determining the power level of the batteries.

As described above, the dispenser 10 can include a controller and control circuitry 60. The controller and control circuitry 60 can control and monitor all the functions of the dispenser 10 including the length of the sheet of material being dispensed, product usage, and any other activities that are occurring within the dispenser. The control circuitry 60 can be configured to communicate information regarding the dispenser 10 to a central control system (e.g., a cloud-based management service) via wired means or through a web-based system as described more particularly herein.

In one embodiment, the dispenser 10 can include a sensor that is designed to detect the presence of a user in a detection zone. Once the presence of a user is detected, the dispenser 10 can be configured to automatically dispense the sheet product.

Figure 2:
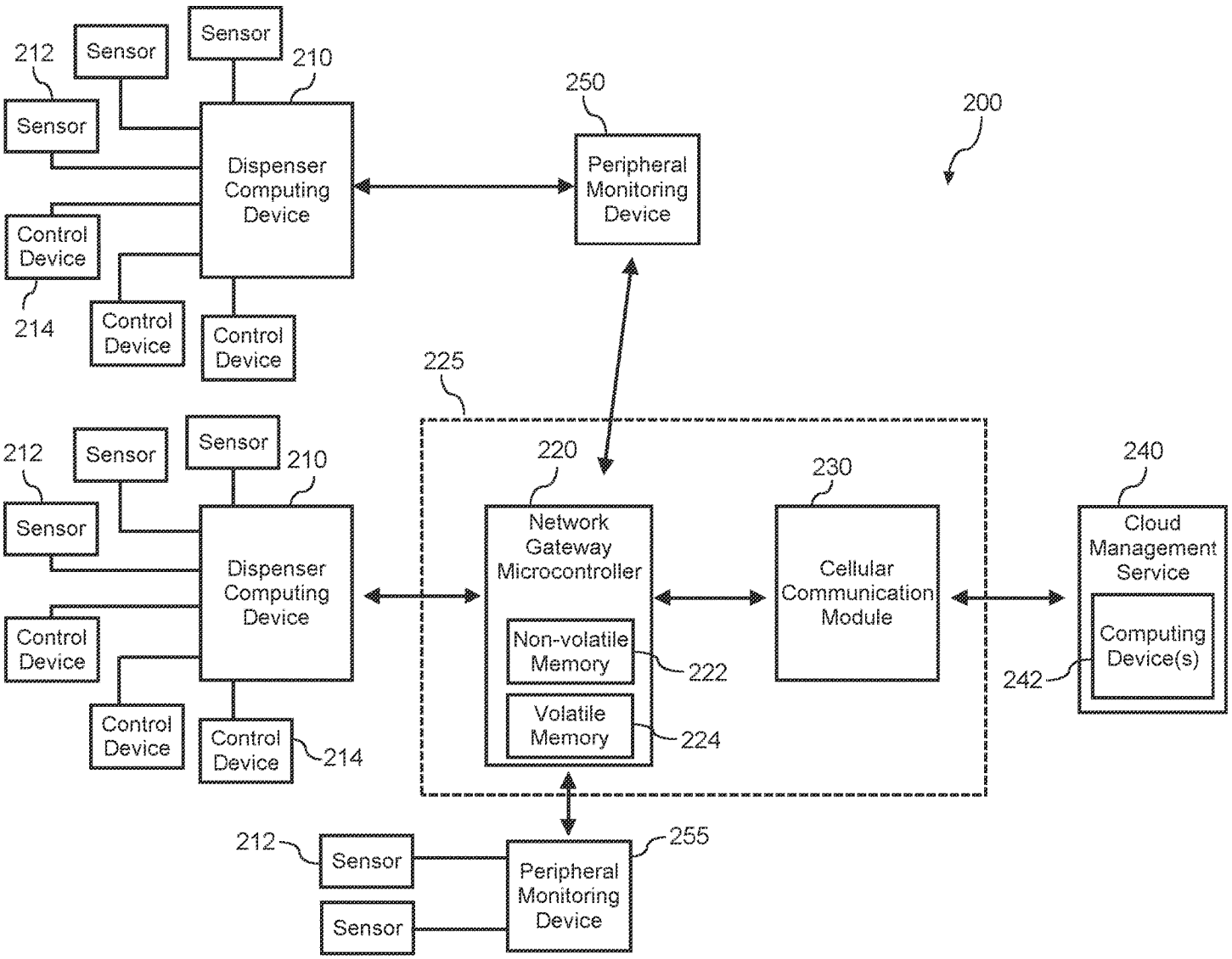
FIG. 2 depicts a block diagram of example dispenser electronics according to example embodiments of the present disclosure.

FIG. 2 depicts a block diagram of example dispenser electronics 200 according to example embodiments of the present disclosure. The dispenser electronics 200 can include dispenser monitoring device 225. The dispenser monitoring device 225 can include a network gateway microcontroller 220 configured to perform operations for monitoring a product dispenser. For instance, the network gateway microcontroller 220 (and/or cellular communications module 230) may be included in a monitoring device 225 configured to interface with and/or integrated into a dispenser. Additionally and/or alternatively, the network gateway microcontroller 220 can be configured to provide networking functions for the product dispenser. For instance, the monitoring device 225 can include a standalone gateway microcontroller 220 that is integrated into the product dispenser, separately attached to the product dispenser, etc. The network gateway microcontroller 220 may be a microcontroller associated with a wireless module, such as a Bluetooth or BLE module. In some implementations, the network gateway microcontroller 220 is configured to run a real-time operating system (RTOS) to implement the operations for monitoring the product dispenser.

As depicted in FIG. 2, the dispenser electronics 200 can include dispenser computing device 210. The dispenser computing device 210 can be coupled to sensors 212 and/or control devices 214. The dispenser computing device 210 can obtain data from the sensors 212 configured to monitor a product dispenser. The dispenser computing device 210 can be, for example, a microcontroller and/or a microprocessor and/or any other suitable computing device. The dispenser computing device 210 can be configured to perform operations for operating the product dispenser, such as, for example, sensing the presence of a users body, appendage, etc. and/or dispensing an amount of the product, such as in response to sensing the presence of a user's body. For instance, the dispenser computing device 210 can control one or more control devices 214 (e.g., motors, switches, dispensing mechanisms, etc.) to operate the dispenser. Additionally and/or alternatively, the dispenser computing device 210 can obtain and/or transmit dispenser data from one or more sensors 212. In some implementations, the dispenser computing device 210 can be omitted (e.g., for a manual dispenser) such that the network gateway microcontroller 220 can obtain data directly from the sensors 212.

The network gateway microcontroller 220 can be configured to establish a wireless connection with one or more peripheral dispenser monitoring devices, such as peripheral monitoring devices 250 and 255. As illustrated, monitoring device 250 can be configured to couple to a dispenser computing device 210. Monitoring device 255 can be configured to obtain data directly from sensors 212. Each of the peripheral monitoring devices 250, 255 can be associated with a dispenser. For instance, in some implementations, the network gateway microcontroller 220 and/or the monitoring device 225 can act as a central gateway and may establish connections to and/or aggregate data from a plurality of other dispensers (e.g., peripheral monitoring devices 250, 255). Additionally and/or alternatively, the network gateway microcontroller 220 may establish a connection with a dispenser into which the network gateway microcontroller 220 and/or the monitoring device 225 is integrated. In some implementations, the network gateway microcontroller 220 (e.g., the monitoring device 225) may be a standalone device that is not integrated into a dispenser. As illustrated, the network gateway microcontroller 220 can include onboard non-volatile memory 222 and/or onboard volatile memory 224.

As used herein, "establishing" a wireless connection can include any suitable method of communication between two or more wireless devices without utilizing a continuous physical signal transmission medium. As an example, establishing a wireless connection can include forming a two-way connection. Additionally and/or alternatively, the wireless connection may be or include a beacon connection such that the peripheral monitoring devices 250, 255 are configured to broadcast beacon data and the network gateway microcontroller 220 is configured to scan for the beacon data. Once the beacon data is recognized, the network gateway microcontroller 220 can obtain the beacon data. This can be accomplished without necessarily providing any communications from the network gateway microcontroller 220 to the device broadcasting the beacon data.

In one example implementation, it was found that establishing two-way (e.g., Bluetooth) connections limited a number of devices that could be in communication with a single network gateway microcontroller. In the example implementation, for instance, the network gateway microcontroller could reliably form and/or maintain only up to about five connections given resource constraints of the microcontroller. By using broadcasted one-way beacon data as described herein, however, the network gateway microcontroller could service more devices, such as up to 30 devices or even up to devices with no other changes (e.g., to hardware). In this way, the network gateway microcontroller can aggregate and provide data from a greater number of devices under limited resource constraints, which can be beneficial for servicing larger networks of devices.

The network gateway microcontroller can be configured to obtain dispenser data from the one or more monitoring devices via the wireless connection. For instance, the network gateway microcontroller can communicate with the one or more dispenser monitoring devices via a wireless protocol (e.g., BLE) over the wireless connection. In some implementations, the network gateway microcontroller may communicate with the one or more dispenser monitoring devices via one or more peripheral monitoring device microcontrollers which may or may not be network gateway microcontrollers. For instance, in some implementations, some or all of the dispenser computing devices may be coupled to a peripheral microcontroller that provides networking functionality (e.g., establishing wireless connections) for a respective dispenser and/or dispenser computing device. For instance, in some implementations, the network gateway microcontroller can further be configured to establish a wireless connection with one or more peripheral dispenser monitoring devices each associated with a peripheral dispenser and aggregate the dispenser data from the one or more peripheral dispenser monitoring devices. In this way, data can be provided to and/or aggregated from a plurality of dispensers (e.g., a network of dispensers) without requiring individual higher-power (e.g., internet) connections be formed with each dispenser. For instance, this can provide for a cloud-based management service to serve a greater number of dispensers, such as dispensers of an entire office building.

The network gateway microcontroller 220 can be configured to obtain dispenser data from the peripheral monitoring devices 250, 255, via the wireless connection. For instance, the network gateway microcontroller 220 can communicate with the peripheral monitoring devices 250, 255 via a wireless protocol (e.g., BLE) over the wireless connection. For instance, in some implementations, the network gateway microcontroller 220 can further be configured to establish a wireless connection with one or more peripheral monitoring devices 250, 255 each associated with a peripheral dispenser and aggregate the dispenser data from the one or more peripheral monitoring devices 250, 255. In this way, data can be provided to and/or aggregated from a plurality of dispensers (e.g., a network of dispensers) without requiring individual higher-power (e.g., internet) connections be formed with each dispenser.

The network gateway controller 220 can further be configured to provide the dispenser data (e.g., via a cellular connection) to a cloud-based management service 240. As an example, the gateway monitoring device 220 can include a cellular communication module 230 configured to provide cellular communications to the cloud-based management service 240. Additionally and/or alternatively, the data can be communicated by any other suitable connection, such as a Wi-Fi connection, an ethernet connection, etc. The cloud-based management service 240 can be a remote service (e.g., at one or more remote computing devices, such as computing device(s) 242) from which an observer (e.g., a human and/or automated observer) can monitor the dispensers. For instance, the cloud-based management service 240 can display or otherwise provide information on dispenser status, such as product level, errors, commands, usage history, software versioning, etc. In some implementations, the dispenser data is provided to the cloud-based management service 240 by a CoAP connection utilizing a Lightweight Machine to Machine (LWM2M) standard. For instance, the CoAP connection utilizing a Lightweight Machine to Machine (LWM2M) standard can provide a low data overhead for wireless communications. As one example, the cloud-based management service 240 can be configured to organize and/or store data associated with each dispenser and/or provide the data for viewing by a user.

In some implementations, the dispenser data can include one or more resources. As one example, the Lightweight M2M standard can provide for the inclusion of resources in the dispenser data. Each of the one or more resources can be associated with one or more data feeds. For instance, in some implementations, each data feed can correspond to a particular dispenser data item, such as a sensor reading, product level, etc. In some implementations, one or more of these data feeds can be grouped into a single resource such that all of the data feeds are transmitted simultaneously. As one example, each resource can include a list (e.g., a JSON-like list) of data feed identifiers and values. In some implementations, the data feed identifiers may be truncated or aliased to minimize the size of the resource packets.

In some implementations, the one or more resources can include at least one of a data collection resource, a settings resource, a commands resource, a differential rules resource, or an alerts resource. For instance, the data collection resource can be used for "one-way" data, such as data that is collected from a dispenser and generally not written to, such as, for example, product level, device type, device identifier, software version, network identifiers, battery charge characteristics, temperatures, diagnostic and debugging values, and other suitable data. Additionally and/or alternatively, the settings resource can be used for dispenser settings, such as towel length, networking settings, power toggles, alert thresholds, operational parameters, and other suitable settings. The commands resource can be used for (e.g., manually) forcing the dispenser to perform commands, such as resets or power cycles, manual dispensing, applying or updating data, write commands, and other suitable commands. The differential rules resource can be used for configuring differential rules for dispensers. The alerts resource can be used for receiving alerts from the dispenser, such as product level alerts, error alerts, and other suitable alerts.

In some implementations, the monitoring device and/or the dispenser can include a cellular communication module 230 coupled to the network gateway microcontroller 220. The cellular communication module 230 can be configured to provide cellular network communications over one or more cellular networks, such as 4G and/or 5G cellular networks. The network gateway microcontroller 220 can be configured to provide the dispenser data to the cloud-based management service 240 via the one or more cellular networks. Additionally and/or alternatively, any other suitable method for providing dispenser data to a cloud-based management service 240 (e.g., via Wi-Fi, ethernet, etc.) can be employed according to example aspects of the present disclosure.

Additionally and/or alternatively, in some implementations, the network gateway microcontroller 220 can be further configured to receive over the air (OTA) data from the cloud-based management service 240. In some implementations, the OTA data can be or can include software updates and/or firmware updates for a dispenser and/or components thereof (e.g., for a dispenser computing device 210, sensors 212, control devices, the network gateway microcontroller 220, etc.). Additionally and/or alternatively, in some implementations, the OTA data can be or can include commands for the dispenser(s). The network gateway microcontroller 220 can provide the OTA data to the peripheral monitoring devices 250, 255 via the wireless connection. For instance, the OTA data can be received at the network gateway microcontroller 220 and/or distributed to other dispensers via the wireless connection.

Figure 3:
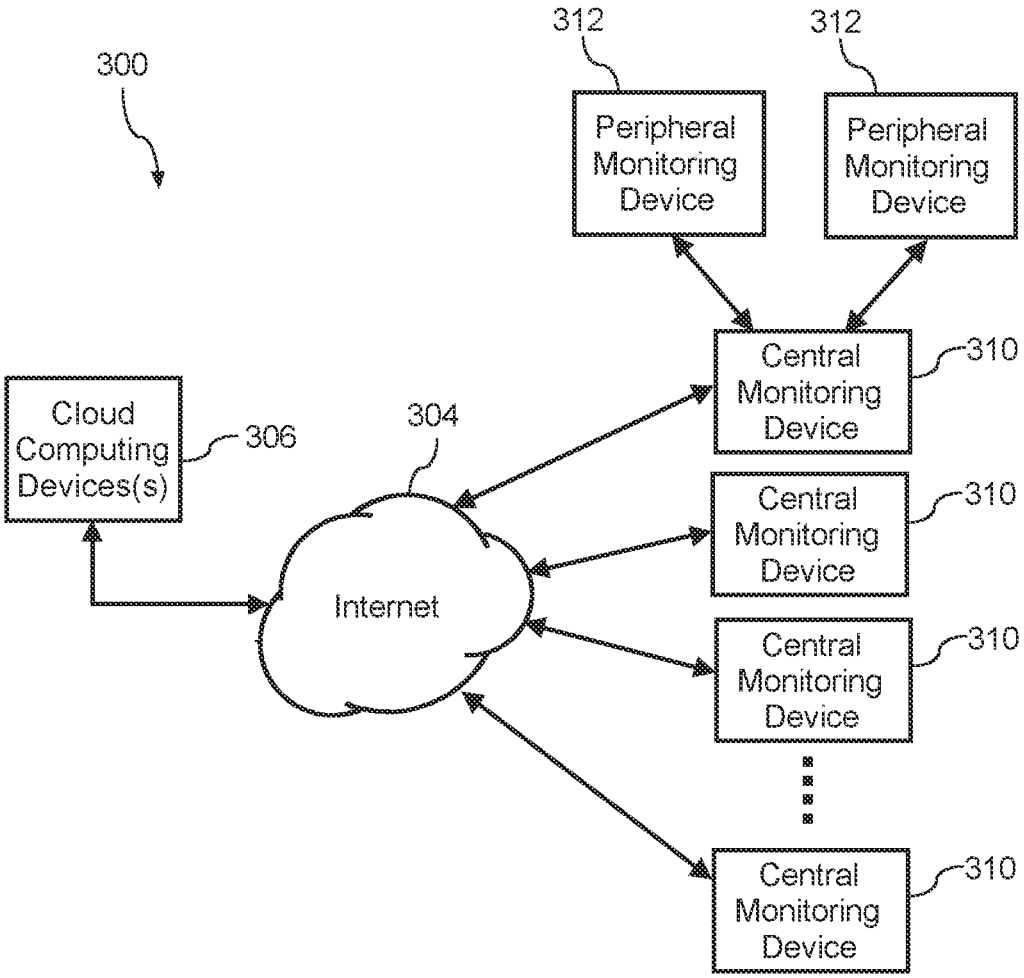
FIG. 3 depicts a block diagram of a network enabled dispenser system according to example embodiments of the present disclosure.

FIG. 3 depicts a block diagram of a network enabled dispenser system 300 according to example embodiments of the present disclosure. Multiple central dispenser 310 devices are shown. The central dispensers 310 may be, for example, dispenser 10 of FIG. 1. The central dispensers 310 may be connected to the internet 304. For instance, the central dispensers 310 may act as a gateway that establishes wireless connection(s) with one or more peripheral monitoring device(s) 312 (e.g., configured to monitor peripheral dispenser(s)). The central dispensers 310 may aggregate dispenser data from the peripheral monitoring device(s) 312 and/or transmit the aggregated dispenser data to a cloud based-management service that may be accessed by and/or otherwise formed by cloud computing device(s) 306 via the internet 304. For instance, wireless connections can be established between central dispensers 310 and peripheral monitoring device(s) 312 by a first wireless protocol, such as a Bluetooth Low Energy (BLE) protocol. Wireless connections between a central dispenser 310 (e.g., a gateway) and the internet 304 (e.g., a cloud-based management service) may be established by a second wireless protocol, such as by cellular communications.

Figure 4:
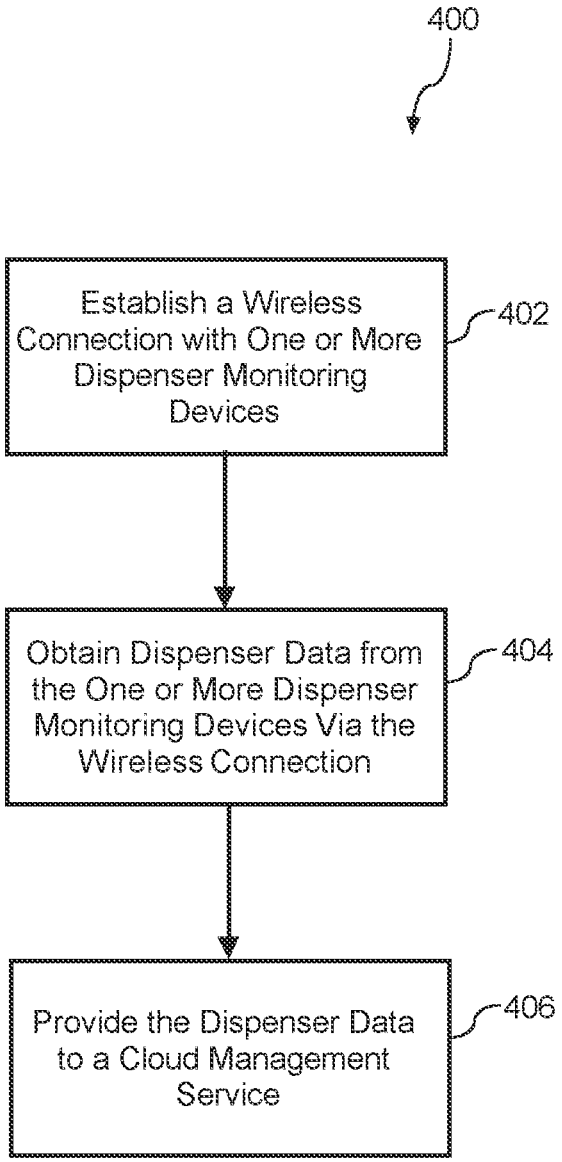
FIG. 4 depicts a block diagram of an example method for monitoring a product dispenser according to example embodiments of the present disclosure.

FIG. 4 depicts a block diagram of an example method 400 for monitoring a product dispenser according to example embodiments of the present disclosure. Although FIG. 4 depicts steps performed in a particular order for purposes of illustration and discussion, the methods of the present disclosure are not limited to the particularly illustrated order or arrangement. The various steps of the method 400 can be omitted, rearranged, combined, and/or adapted in various ways without deviating from the scope of the present disclosure.

In some implementations, the method 400 may be implemented by a network gateway microcontroller configured to perform operations for monitoring the product dispenser. The network gateway microcontroller may be a microcontroller associated with a wireless module, such as a Bluetooth or BLE module. In some implementations, the network gateway microcontroller is configured to run a real-time operating system (RTOS) to implement the operations for monitoring the product dispenser (e.g., the method 400).

The method 400 can include, at 402, establishing (e.g., by a network gateway microcontroller) a wireless connection with one or more dispenser monitoring devices. Each of the one or more dispenser monitoring devices can be associated with a dispenser. For instance, in some implementations, the network gateway microcontroller can act as a central gateway and may establish connections to and/or aggregate data from a plurality of other dispensers (e.g., other monitoring devices). Additionally and/or alternatively, the network gateway microcontroller may establish a wired and/or wireless connection with a dispenser into which the network gateway microcontroller is integrated. In some implementations, the network gateway microcontroller (e.g., the monitoring device) may be a standalone device that is not integrated into a dispenser.

As used herein, "establishing" a wireless connection can include any suitable method of communication between two or more wireless devices without utilizing a continuous physical signal transmission medium. As an example, establishing a wireless connection can include forming a two-way connection. Additionally and/or alternatively, the wireless connection may be or include a beacon connection such that the dispenser computing devices (e.g., and/or monitoring devices of other dispensers) are configured to broadcast beacon data and the network gateway microcontroller is configured to scan for the beacon data. Once the beacon data is recognized, the network gateway microcontroller can obtain the beacon data. This can be accomplished without necessarily providing any communications from the network gateway microcontroller to the device broadcasting the beacon data. Establishing traditional (e.g., two-way) connections can require significant overhead. Use of beacon connections can increase a number of connections that may be reliably established by the microcontroller, such as by a tenfold increase.

The method 400 can include, at 404, obtaining (e.g., by the network gateway microcontroller) dispenser data from the one or more dispenser monitoring devices via the wireless connection. For instance, the network gateway microcontroller can communicate with the one or more dispenser monitoring devices via a wireless protocol (e.g., BLE) over the wireless connection. For instance, in some implementations, the network gateway microcontroller can further be configured to establish a wireless connection with one or more peripheral dispenser monitoring devices each associated with a peripheral dispenser and aggregate the dispenser data from the one or more peripheral dispenser monitoring devices. In this way, data can be provided to and/or aggregated from a plurality of dispensers (e.g., a network of dispensers) without requiring individual higher-power (e.g., internet) connections be formed with each dispenser.

The method 400 can include, at 406, providing (e.g., by the network gateway microcontroller) the dispenser data to a cloud-based management service. The dispenser data can be provided to the cloud-based management service by an internet connection. The internet connection can be or can include any suitable type(s) of internet connections, such as, for example, a cellular service connection, a Wi-Fi connection, an ethernet connection, and/or any other suitable internet connections, and/or combinations thereof. The cloud-based management service can be a remote service (e.g., at a remote computing device) from which an observer (e.g., a human and/or automated observer) can monitor the dispensers. For instance, the cloud-based management service can display or otherwise provide information on dispenser status, such as product level, errors, commands, usage history, software versioning, etc. In some implementations, the dispenser data is provided to the cloud-based management service by a CoAP connection utilizing a Lightweight Machine to Machine (LWM2M) standard. For instance, the CoAP connection utilizing a Lightweight Machine to Machine (LWM2M) standard can provide a low data overhead for wireless communications.

In some implementations, the dispenser data can include one or more resources. As one example, the Lightweight M2M standard can provide for the inclusion of resources in the dispenser data. Each of the one or more resources can be associated with one or more data feeds. For instance, in some implementations, each data feed can correspond to a particular dispenser data item, such as a sensor reading, product level, etc. In some implementations, one or more of these data feeds can be grouped into a single resource such that all of the data feeds are transmitted simultaneously. As one example, each resource can include a list (e.g., a JSON-like list) of data feed identifiers and values. In some implementations, the data feed identifiers may be truncated or aliased to minimize the size of the resource packets. Generally, each resource can carry a significant overhead, so combining data feeds into (e.g., categorized) resources can significantly reduce computing resource usage.

In some implementations, the one or more resources can include at least one of a data collection resource, a settings resource, a commands resource, a differential rules resource, or an alerts resource. For instance, the data collection resource can be used for "one-way" data, such as data that is collected from a dispenser and generally not written to, such as, for example, product level, device type, device identifier, software version, network identifiers, battery charge characteristics, temperatures, diagnostic and debugging values, and other suitable data. Additionally and/or alternatively, the settings resource can be used for dispenser settings, such as towel length, networking settings, power toggles, alert thresholds, operational parameters, and other suitable settings. The commands resource can be used for (e.g., manually) forcing the dispenser to perform commands, such as resets or power cycles, manual dispensing, applying or updating data, write commands, and other suitable commands. The differential rules resource can be used for configuring differential rules for dispensers. The alerts resource can be used for receiving alerts from the dispenser, such as product level alerts, error alerts, and other suitable alerts.

In some implementations, the monitoring device and/or the dispenser can include a cellular communication module coupled to the network gateway microcontroller. The cellular communication module can be configured to provide cellular network communications over one or more cellular networks, such as 4G and/or 5G cellular networks. The dispenser data can be provided to the cloud-based management service via the one or more cellular networks. Additionally and/or alternatively, any other suitable method for providing dispenser data to a cloud-based management service (e.g., via Wi-Fi, ethernet, etc.) can be employed according to example aspects of the present disclosure.

Additionally and/or alternatively, in some implementations, the method 400 can further include receiving over the air (OTA) data from the cloud-based management service. In some implementations, the OTA data can be or can include software updates and/or firmware updates for a dispenser and/or components thereof (e.g., for a dispenser computing device, sensors, control devices, the network gateway microcontroller, etc.). Additionally and/or alternatively, in some implementations, the OTA data can be or can include commands for the dispenser(s). The network gateway microcontroller can provide the OTA data to the one or more dispenser computing devices via the wireless connection. For instance, the OTA data can be received at the network gateway microcontroller and/or distributed to other dispensers via the wireless connection.

While exemplary embodiments provided herein are directed to dispenser sensors and dispenser monitoring systems associated therewith, the disclosure is not so limited. Indeed, the monitoring devices and systems described herein can be utilized in any system where there is a need to connect multiple peripheral devices to a central monitoring system.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A monitoring device configured to be coupled to a product dispenser to provide monitoring functionality for the product dispenser, the monitoring device comprising:

a network gateway microcontroller configured to perform operations, the operations comprising:

establishing a wireless connection with one or more dispenser monitoring devices, each of the one or more dispenser monitoring devices associated with a dispenser;

obtaining dispenser data from the one or more dispenser monitoring devices via the wireless connection; and providing the dispenser data via an internet connection to a cloud-based management service;

wherein the network gateway microcontroller is further configured to receive over the air (OTA) data from the cloud-based management service and provide the OTA data to the one or more dispenser monitoring devices via the wireless connection, wherein the OTA data comprises a software update, a firmware update, and/or a command; and wherein the wireless connection comprises a beacon connection such that the one or more dispenser computing devices are configured to broadcast one-way beacon data and the network gateway microcontroller is configured to scan for the one-way beacon data.

2. The monitoring device of claim 1, wherein the OTA data comprises one of a command, a settings update, or a firmware update.

3. The monitoring device of claim 1, further comprising a cellular communication module coupled to the network gateway microcontroller, the cellular communication module configured to provide cellular network communications over one or more cellular networks, wherein the network gateway microcontroller is configured to provide the dispenser data to the cloud-based management service via the one or more cellular networks.

4. The monitoring device of claim 1, wherein the dispenser data is provided to the cloud-based management service by a CoAP connection utilizing a Lightweight Machine to Machine (LWM2M) standard.

5. The monitoring device of claim 1, wherein the network gateway microcontroller comprises a Bluetooth Low Energy (BLE) system.

6. The monitoring device of claim 1, wherein the network gateway microcontroller is configured to employ a real-time operating system (RTOS) to implement the operations.

7. The monitoring device of claim 1, wherein the dispenser data comprises one or more resources, each of the one or more resources associated with one or more data feeds.

8. The monitoring device of claim 7, wherein the one or more resources comprises at least one of a data collection resource, a settings resource, a commands resource, a differential rules resource, or an alerts resource.

9. A dispenser for dispensing a product, the dispenser comprising:

a housing having an interior volume so as to retain a product;

a dispensing mechanism contained within the housing for dispensing the product;

one or more sensors configured to monitor the dispensing mechanism;

a dispenser computing device configured to control the dispensing mechanism, the dispenser computing device configured to obtain dispenser data from the one or more sensors; and a monitoring device comprising a network gateway microcontroller configured to perform operations, the operations comprising:

obtaining the dispenser data from the dispenser computing device via a wireless connection; and providing the dispenser data to a cloud-based management service;

wherein the network gateway microcontroller is further configured to receive over the air (OTA) data from the cloud-based management service and provide the OTA data to the dispenser computing device, wherein the OTA data comprises a software update, a firmware update, and/or a command; and wherein the wireless connection comprises a beacon connection such that the one or more dispenser computing devices are configured to broadcast one-way beacon data and the network gateway microcontroller is configured to scan for the one-way beacon data.

10. The dispenser of claim 9, wherein the network gateway microcontroller is further configured to establish a wireless connection with one or more peripheral dispenser monitoring devices each associated with a peripheral dispenser and aggregate the dispenser data from the one or more peripheral dispenser monitoring devices.

11. The dispenser of claim 9, wherein the monitoring devices further comprises a cellular communication module coupled to the network gateway microcontroller, the cellular communication module configured to provide cellular network communications over one or more cellular networks, wherein the network gateway microcontroller is configured to provide the dispenser data to the cloud-based management service via the one or more cellular networks.

12. The dispenser of claim 9, wherein the dispenser data is provided to the cloud-based management service by a CoAP connection utilizing a Lightweight Machine to Machine (LWM2M) standard.

13. The dispenser of claim 9, wherein the dispenser data comprises one or more resources, each of the one or more resources associated with one or more data feeds.

14. The dispenser of claim 9, wherein the network gateway microcontroller comprises a Bluetooth Low Energy (BLE) system.

15. The dispenser of claim 9, wherein the product comprises a liquid material.

16. The dispenser of claim 9, wherein the product comprises a sheet material.

17. A monitoring device configured to be coupled to a peripheral device to provide monitoring functionality for the peripheral device, the monitoring device comprising:

a network gateway microcontroller configured to perform operations, the operations comprising:

establishing a wireless connection with one or more monitoring devices, each of the one or more monitoring devices associated with a peripheral device;

obtaining peripheral device data from the one or more monitoring devices via the wireless connection; and providing the peripheral device data to a cloud-based management service;

wherein the network gateway microcontroller is further configured to receive over the air (OTA) data from the cloud-based management service and provide the OTA data to the dispenser computing device, wherein the OTA data comprises a software update, a firmware update, and/or a command; and wherein the wireless connection comprises a beacon connection such that the one or more dispenser computing devices are configured to broadcast one-way beacon data and the network gateway microcontroller is configured to scan for the one-way beacon data.

* * * * *